US008973191B1

(12) United States Patent
Kvitek

(10) Patent No.: US 8,973,191 B1
(45) Date of Patent: Mar. 10, 2015

(54) BI-ELEVATION PILLOW SYSTEM

(71) Applicant: Kyle M. Kvitek, Denver, CO (US)

(72) Inventor: Kyle M. Kvitek, Denver, CO (US)

( * ) Notice: Subject to any disclaimer, the term of this patent is extended or adjusted under 35 U.S.C. 154(b) by 59 days.

(21) Appl. No.: 13/902,545

(22) Filed: May 24, 2013

Related U.S. Application Data

(63) Continuation-in-part of application No. 13/533,720, filed on Jun. 26, 2012, now abandoned, which is a continuation-in-part of application No. 12/880,148, filed on Sep. 12, 2010, now abandoned, which is a continuation-in-part of application No. 12/425,287, filed on Apr. 16, 2009, now abandoned.

(51) Int. Cl.
*A47G 9/10* (2006.01)

(52) U.S. Cl.
USPC ..... 5/640; 5/657

(58) Field of Classification Search
USPC ..... 5/632, 636, 640, 652, 657
See application file for complete search history.

(56) References Cited

U.S. PATENT DOCUMENTS

| | | | | |
|---|---|---|---|---|
| 1,701,124 | A * | 2/1929 | Safford | 5/636 |
| 4,850,068 | A | 7/1989 | Walpin et al. | |
| 4,987,625 | A * | 1/1991 | Edelson | 5/657 |
| 5,029,350 | A * | 7/1991 | Edelson | 5/652 |
| 5,271,114 | A | 12/1993 | Kjersem | |
| 5,471,691 | A | 12/1995 | Ryndak | |
| D381,234 | S | 7/1997 | Lupoff | |
| D387,599 | S * | 12/1997 | Ryndak | D6/601 |
| 5,765,245 | A | 6/1998 | Breto | |
| D446,676 | S | 8/2001 | Mayes | |
| 6,270,155 | B1 | 8/2001 | Rashid | |
| 6,336,239 | B1 | 1/2002 | Dalton | |
| 7,305,728 | B2 | 12/2007 | Schlieps | |
| D618,944 | S * | 7/2010 | Rothstein et al. | D6/601 |
| 2004/0226096 | A1 | 11/2004 | Davis | |
| 2006/0064821 | A1 | 3/2006 | Pruitt | |
| 2007/0107131 | A1 | 5/2007 | Fux | |
| 2008/0028530 | A1 | 2/2008 | Hao | |

* cited by examiner

*Primary Examiner* — Fredrick Conley

(57) ABSTRACT

A bi-elevation pillow system for allowing two users to lie side by side with each of their heads respectively positioned at a different elevation by using the pillow system has a base pillow member with a general shape of a rectangular prism. The base pillow member has a cavity with a cushion component located inside. A base pillow bottom surface has a linear channel located on it. The system has a secondary pillow member with a general shape of a rectangular prism with a cavity having a cushion component located inside. In a first position for storage, the base pillow bottom surface is rotated against and interfaces with a secondary pillow bottom surface. In a second position for use, the secondary pillow is rotated about a hinge 180 degrees in an open configuration and placed on a ground surface for use.

20 Claims, 12 Drawing Sheets

BI-ELEVATION PILLOW SYSTEM

CROSS REFERENCE

This application claims priority to U.S. non-provisional application Ser. No. 13/533,720 filed Jun. 26, 2012, which is a continuation-in-part of U.S. non-provisional application Ser. No. 12/880,148 filed Sep. 12, 2010, which is a continuation-in-part of U.S. non-provisional application Ser. No. 12/425,287 filed Apr. 16, 2009, the specifications of which are incorporated herein by reference in its entirety.

BACKGROUND OF THE INVENTION

On many occasions, two people may wish to watch television simultaneously while lying close to each other while on a couch, a bed or the floor. It is often difficult for the two individuals to position their respective heads comfortably and still see the television. Sometimes, one or both individuals may prop their head up with a hand or an arm to see the television. Generally, it is common for the individual in the back to have difficulties seeing the television due to the head of the individual positioned in the front blocking their view. The present invention features a bi-elevation pillow system for allowing two users to lie side by side with each of their heads respectively positioned at a different elevation by using the pillow system.

SUMMARY

The present invention features a bi-elevation pillow system for allowing two users to lie side by side with each of their heads respectively positioned at a different elevation by using the pillow system. In some embodiments the system comprises a base pillow member comprising a general shape of a rectangular prism. In some embodiments, a base pillow bottom surface comprises a linear channel located thereon. In some embodiments, the base pillow member further comprises a cavity having a cushion component located therein.

In some embodiments, the system comprises a secondary pillow member comprising a general shape of a rectangular prism. In some embodiments, the secondary pillow member further comprises a cavity having a cushion component located therein.

In some embodiments, in a first position for storage, the base pillow bottom surface interfaces with a secondary pillow bottom surface and is secured in the first position by a first attachment component and a second attachment component. In some embodiments, in a second position for use, the secondary pillow is rotated about a hinge 180 degrees. In some embodiments, the base pillow bottom surface and the secondary pillow bottom surface are placed on a ground surface for use.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
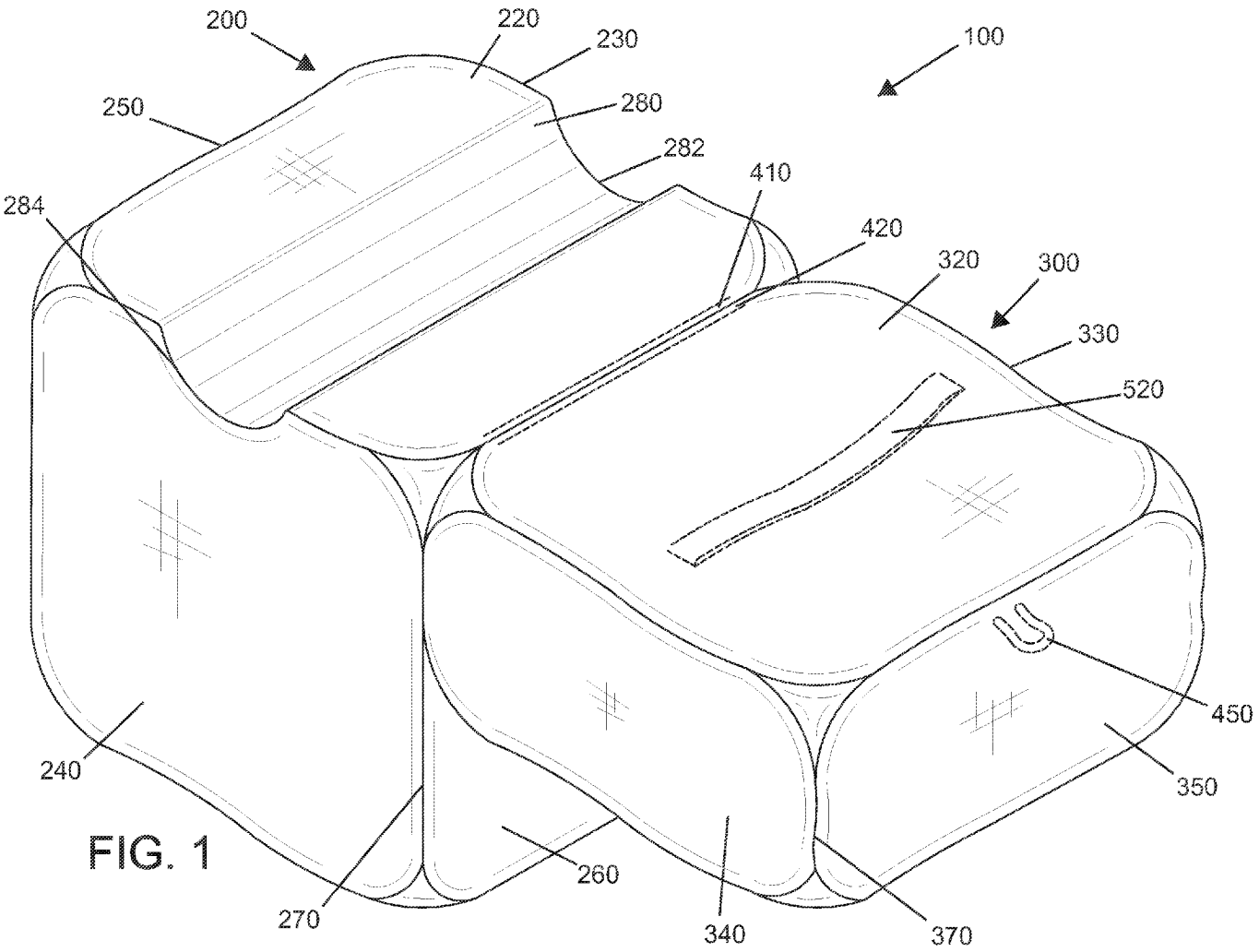
FIG. 1 is a perspective view of the present invention in a second position for use.

Following is a list of elements corresponding to a particular element referred to herein:

100 Bi-elevation pillow system
200 Base pillow member
210 Base pillow top surface
220 Base pillow bottom surface
230 Base pillow first side
240 Base pillow second side
250 Base pillow third side
260 Base pillow fourth side
270 Base pillow edge
280 Linear channel
282 Channel first end
284 Channel second end
300 Secondary pillow member
310 Secondary pillow top surface
320 Secondary pillow bottom surface
330 Secondary pillow first side
340 Secondary pillow second side
350 Secondary pillow third side
360 Secondary pillow fourth side
370 Secondary pillow edge
400 Hinge
410 Base hinge side
420 Secondary hinge side
430 Attachment system
440 First attachment component
450 Second attachment component
460 Button

Figure 2:
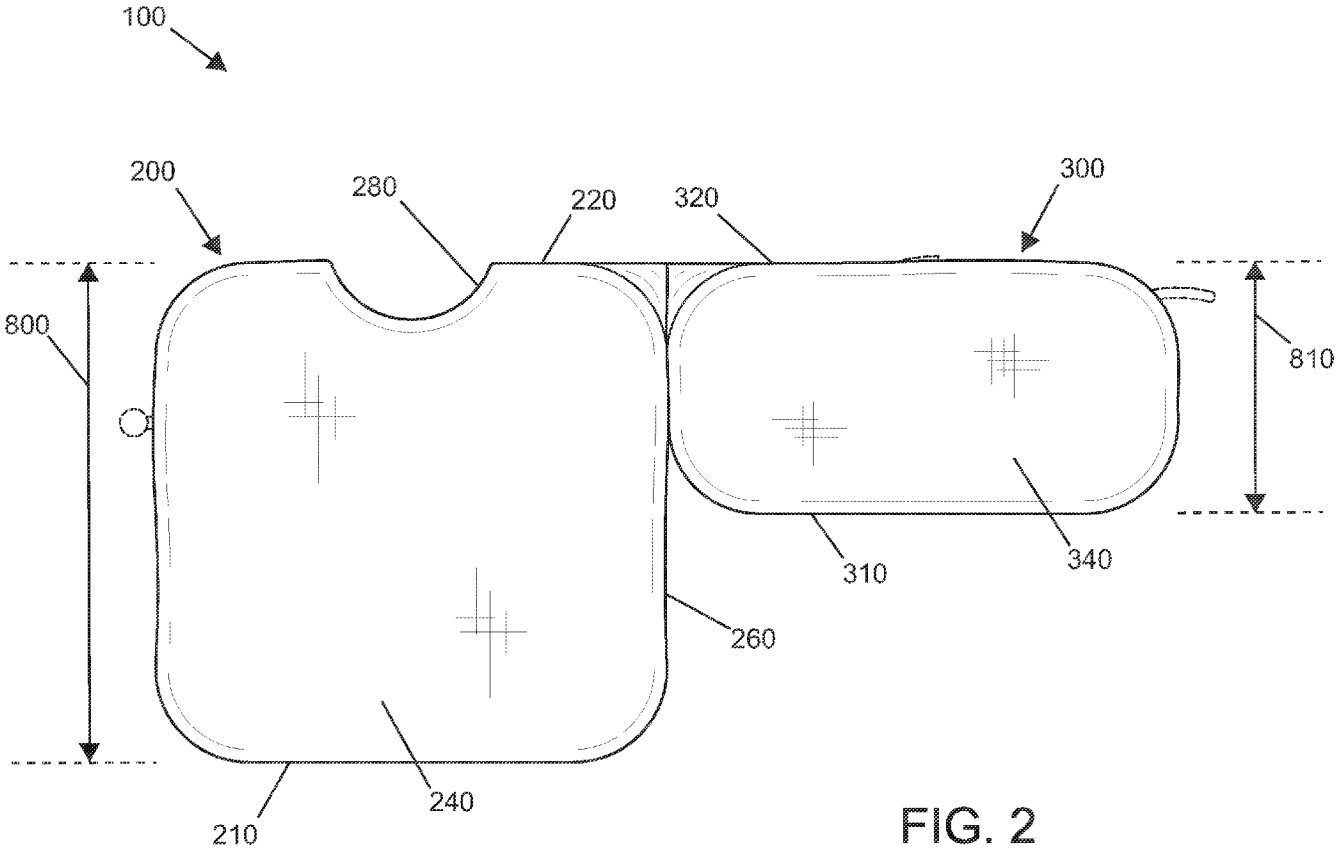
FIG. 2 is a side view of the present invention in a second position for use.
Figure 4:
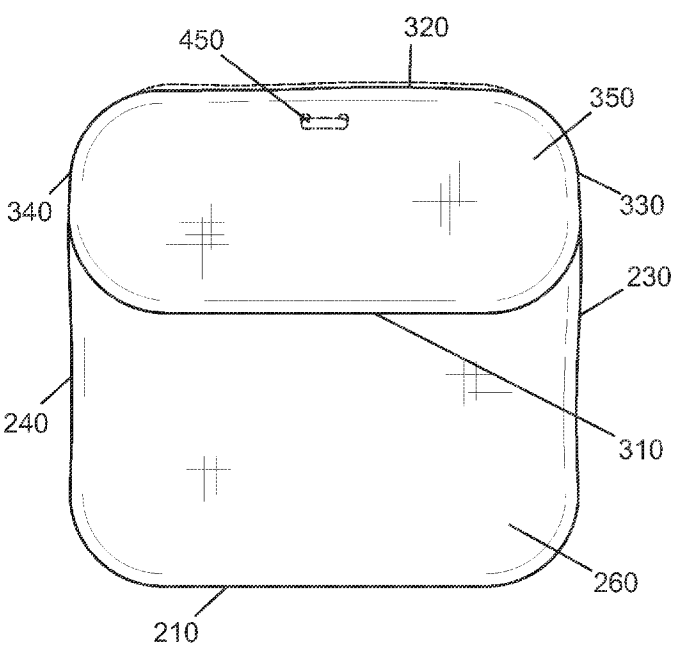
FIG. 4 is a rear view of the present invention in a second position for use.
Figure 3:
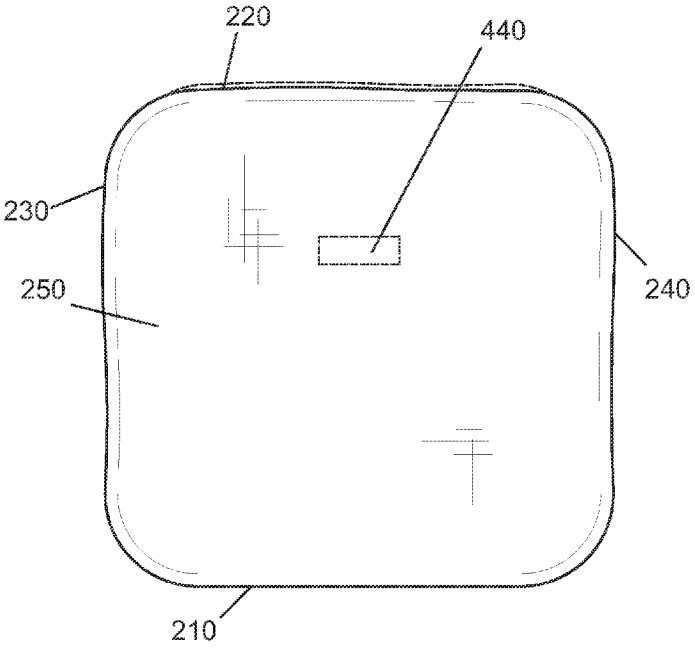
FIG. 3 is a front view of the present invention in a second position for use.
Figure 5:
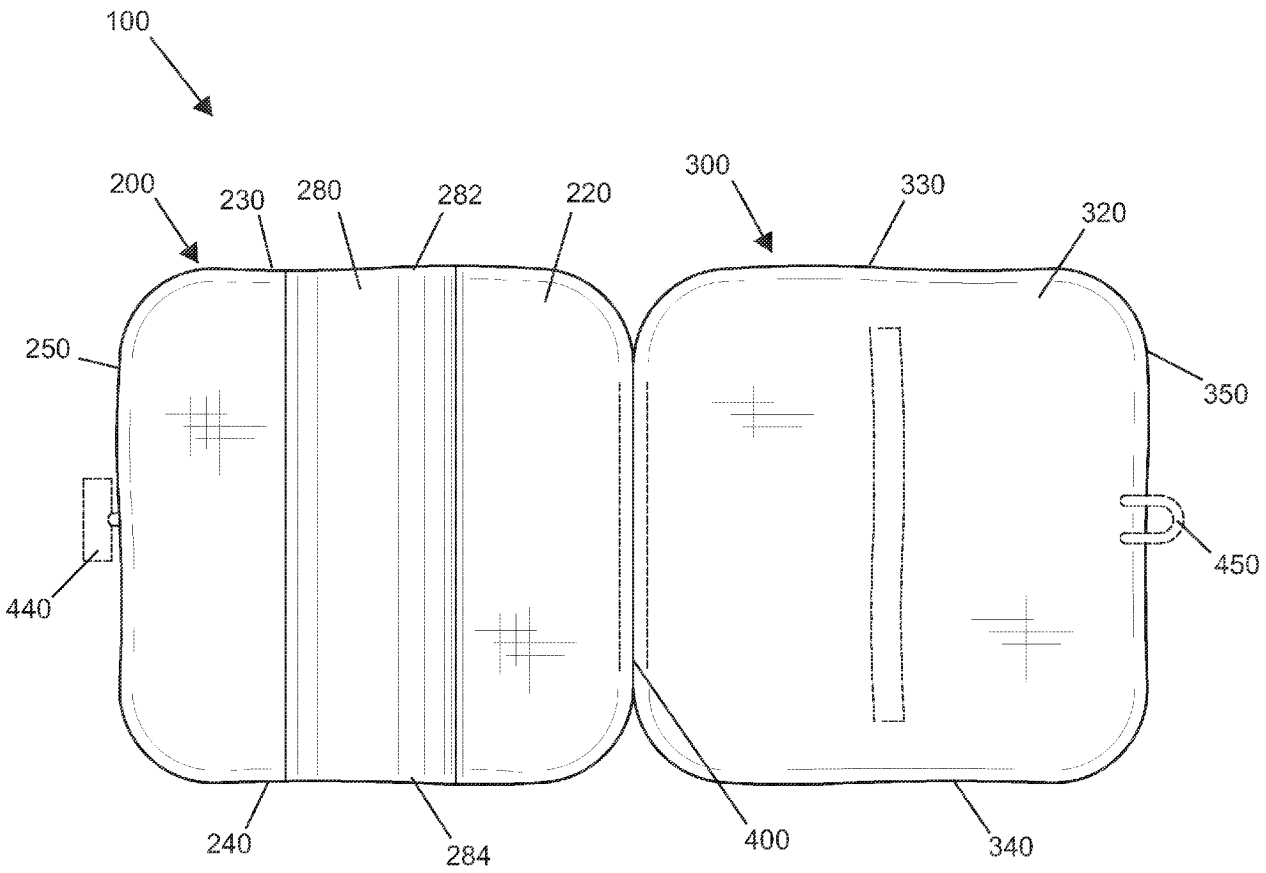
FIG. 5 is a bottom view of the present invention in a second position for use.
Figure 6:
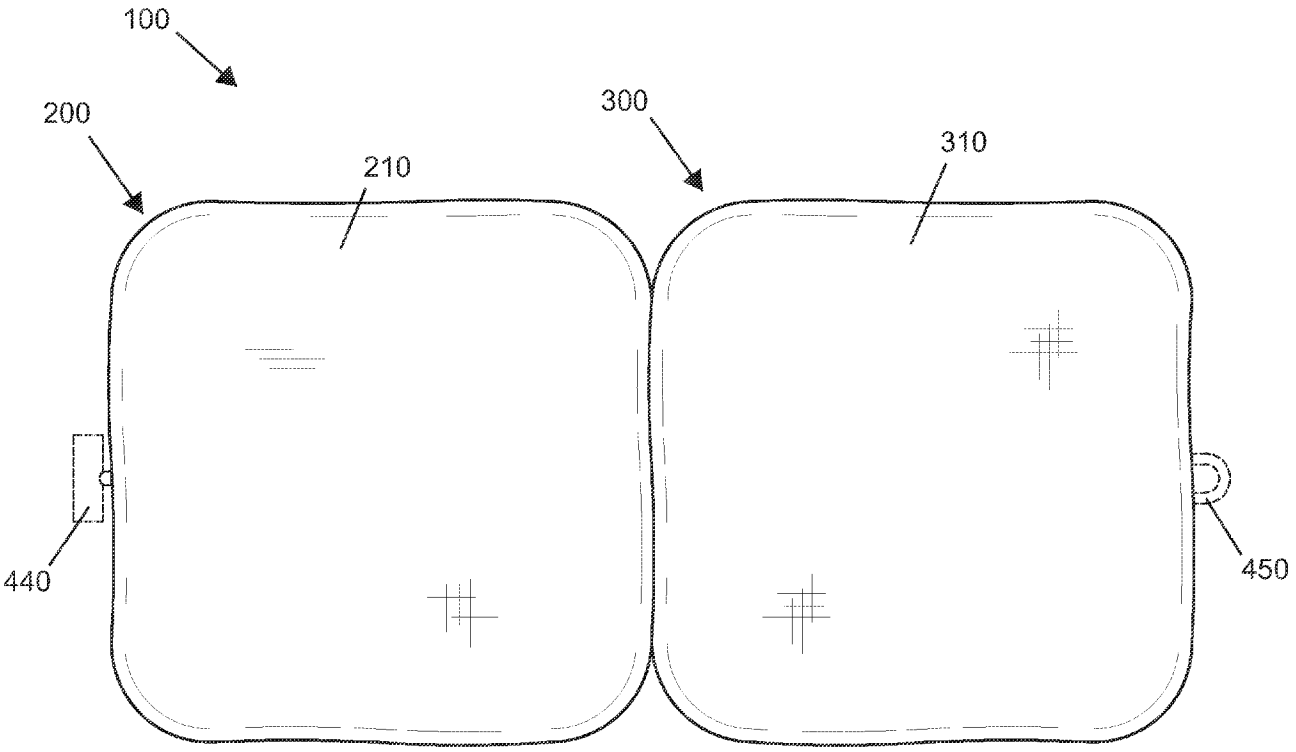
FIG. 6 is a top view of the present invention in a second position for use.
Figure 7:
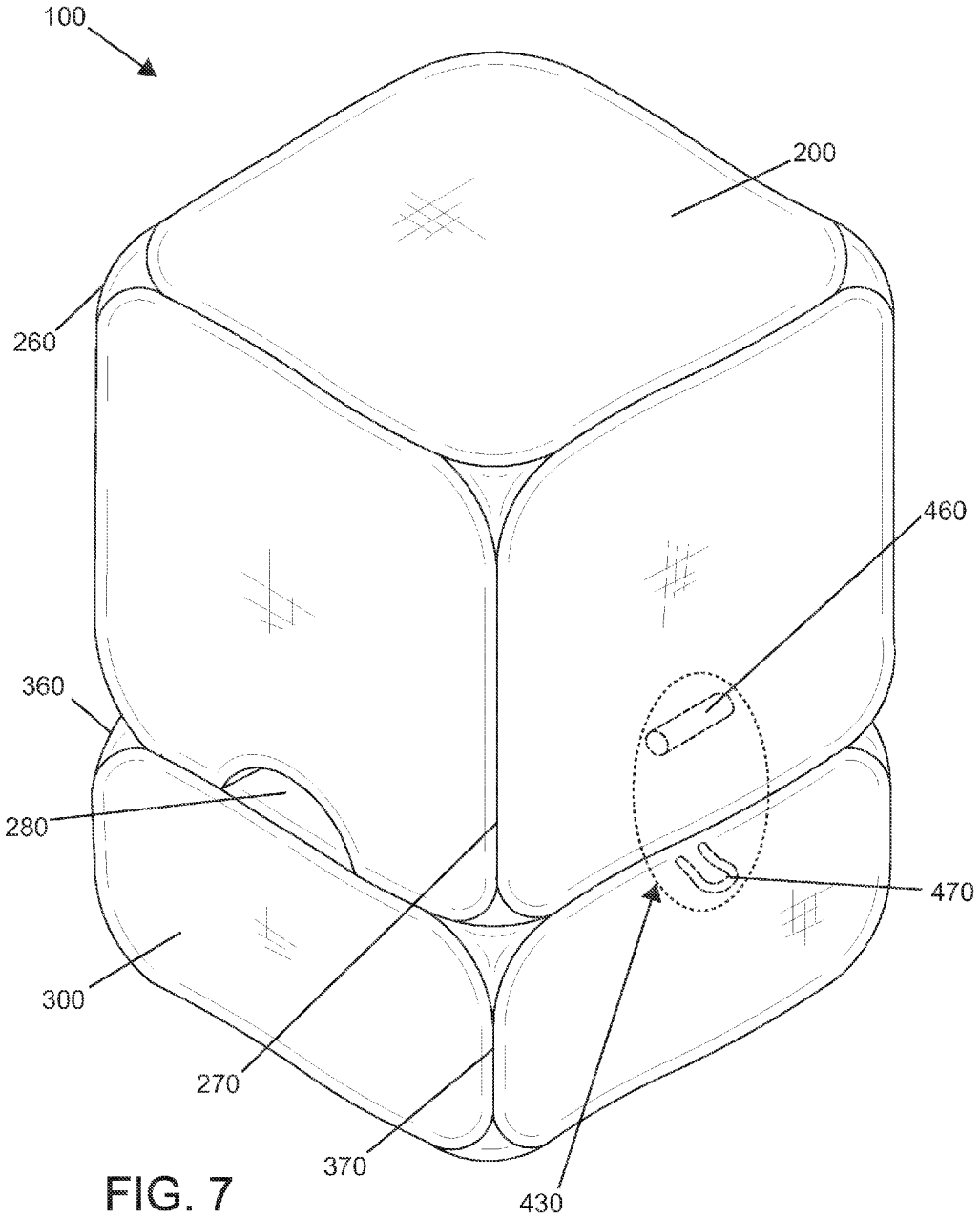
FIG. 7 is a perspective view of the present invention in a first position for storage.
Figure 8:
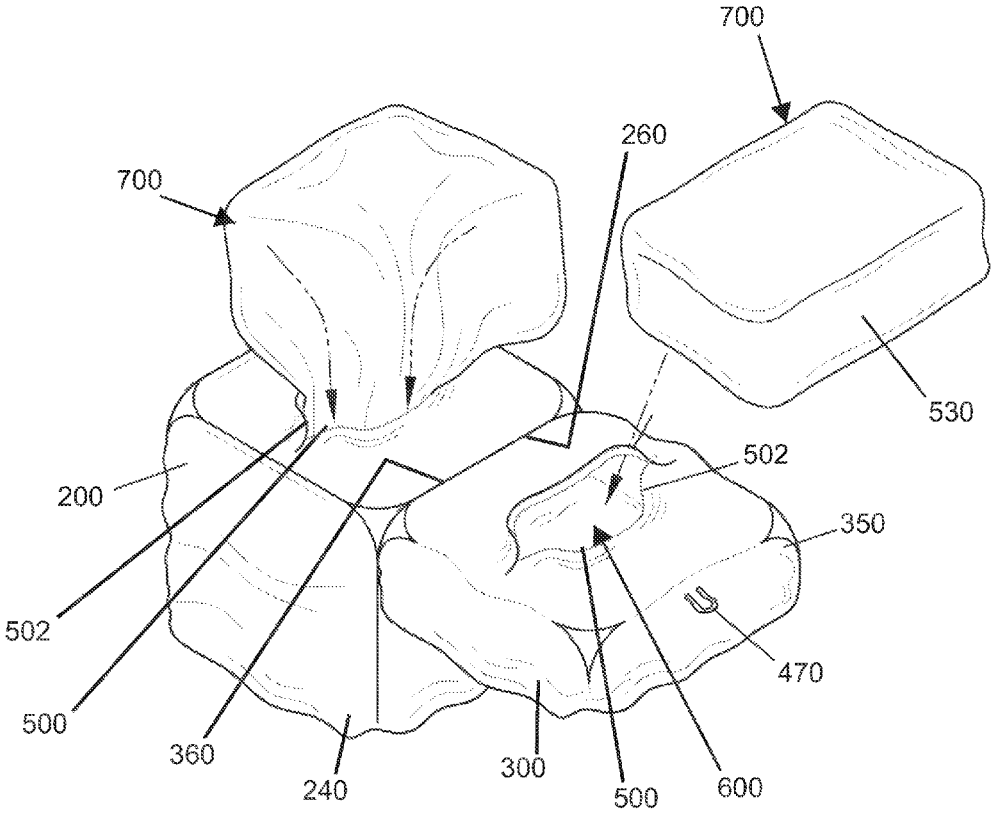
FIG. 8 is a perspective view of the details of the cushion components of the present invention.
Figure 9:
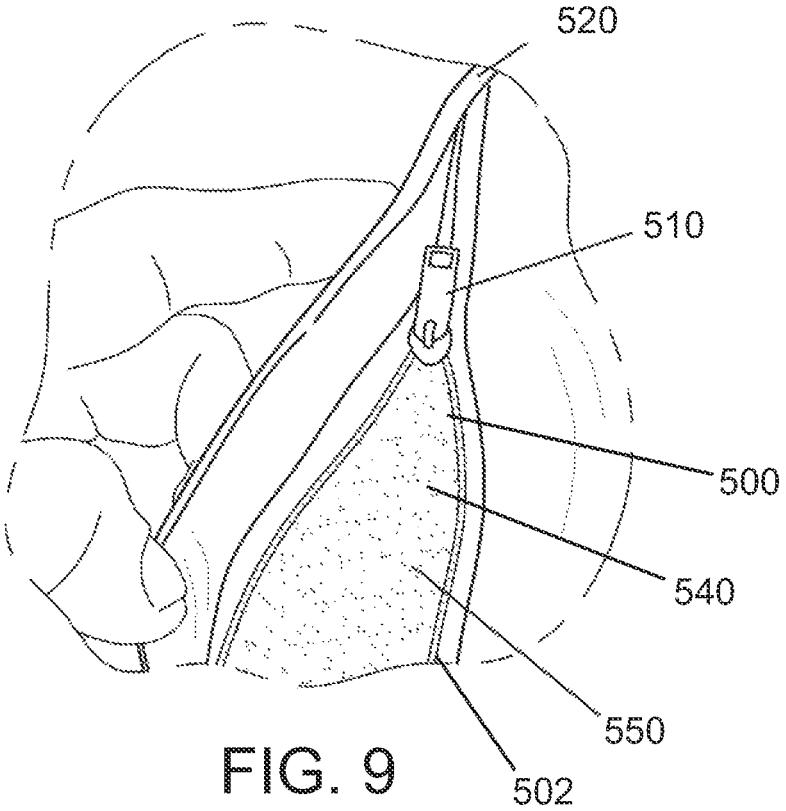
FIG. 9 is a view of the details of the stuffing material of the present invention.
Figure 10:
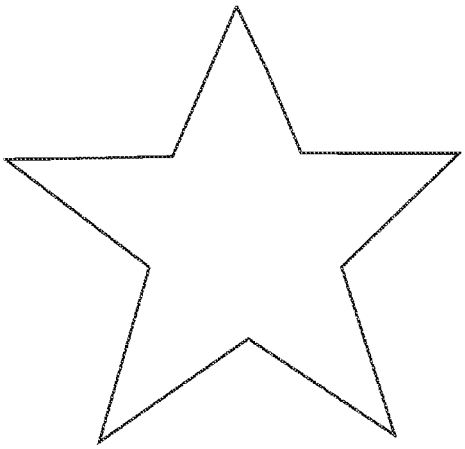
FIG. 10 is a top view of an alternate embodiment of the present invention.
Figure 11:
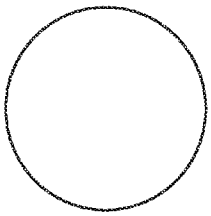
FIG. 11 is a top view of an alternate embodiment of the present invention.
Figure 12:
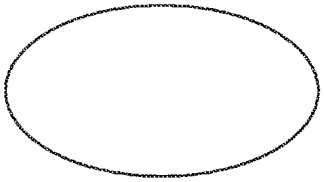
FIG. 12 is a top view of an alternate embodiment of the present invention.
Figure 13:
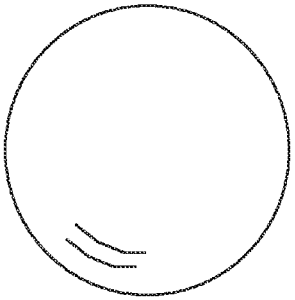
FIG. 13 is a top view of an alternate embodiment of the present invention.
Figure 14:
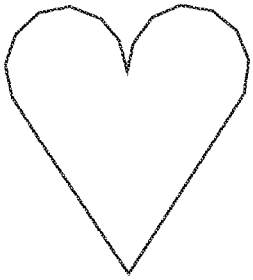
FIG. 14 is a top view of an alternate embodiment of the present invention.
Figure 15:
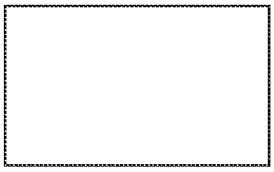
FIG. 15 is a top view of an alternate embodiment of the present invention.
Figure 16:
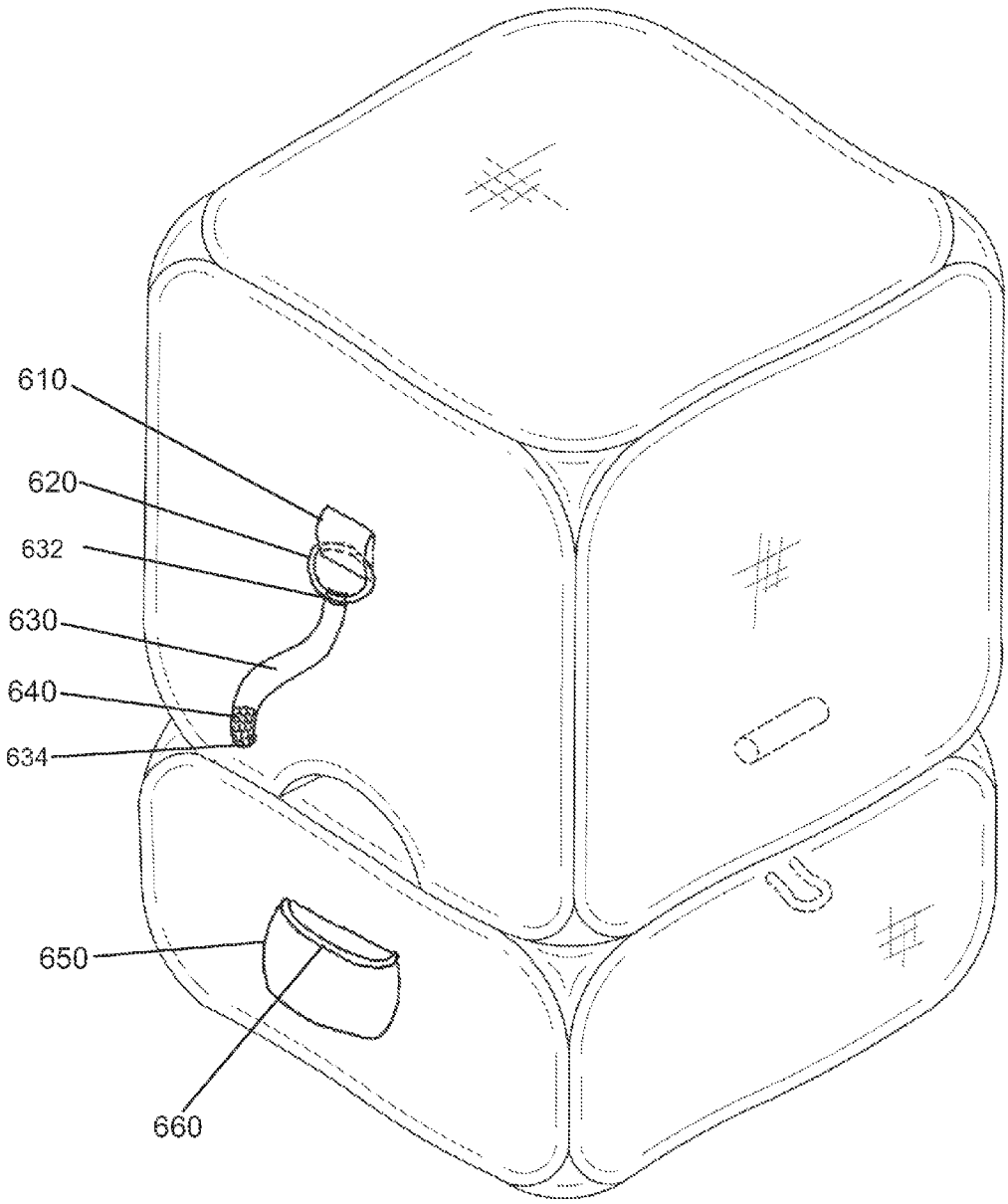
FIG. 16 is a perspective view of an alternate embodiment of the present invention showing a strap and pocket.
Figure 17:
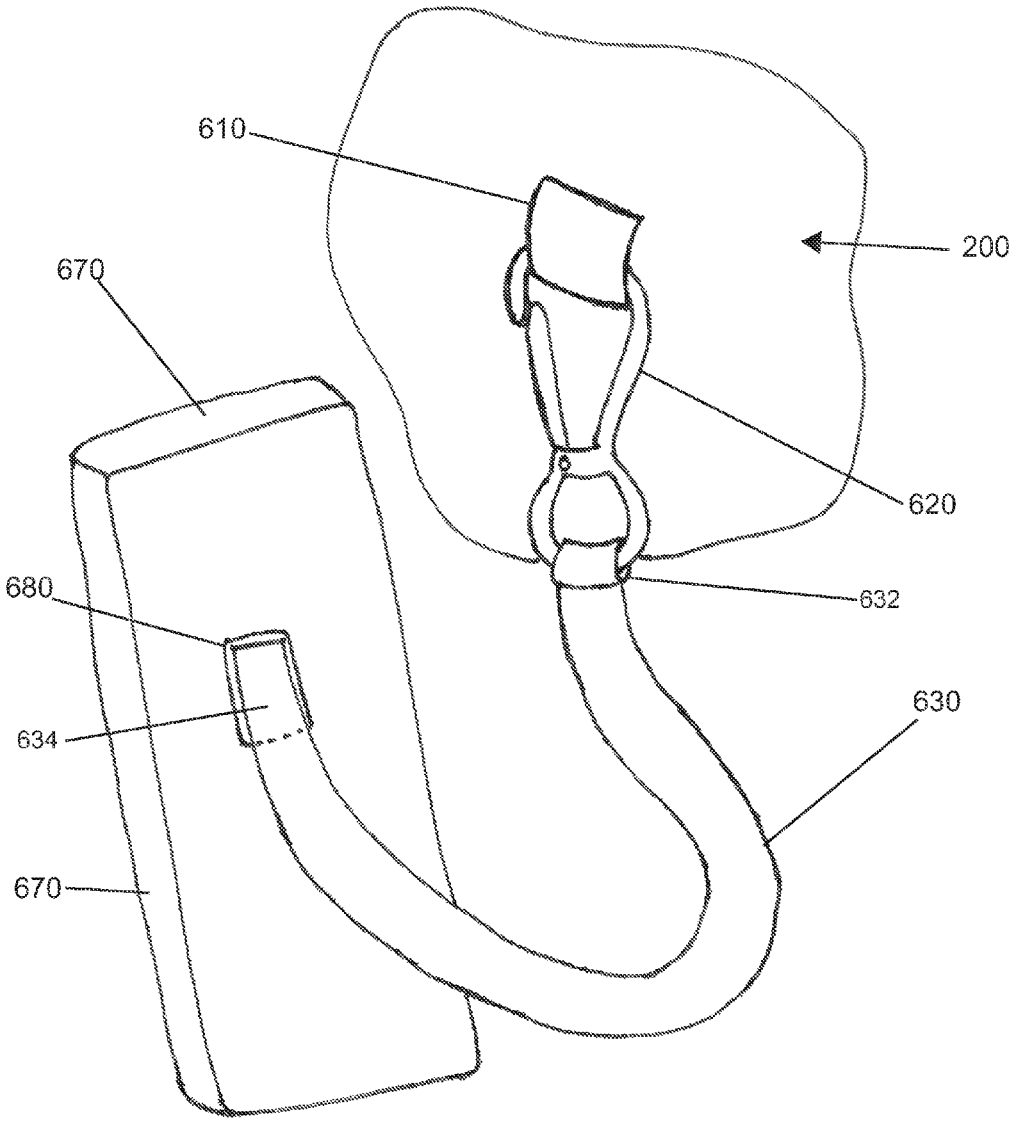
FIG. 17 is detailed in-use view of the strap in conjunction with a remote.
Figure 18:
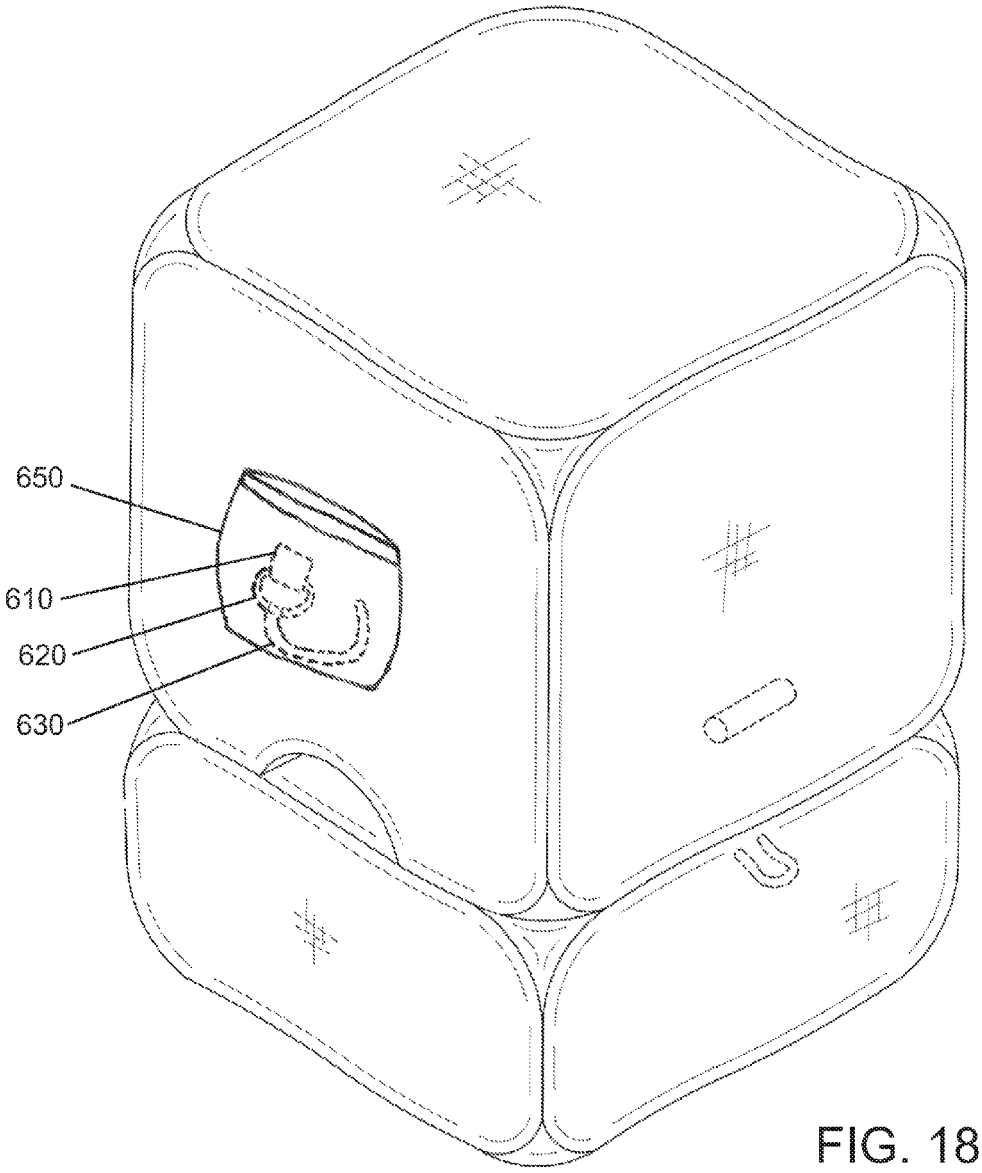
FIG. 18 is a perspective view of an alternate embodiment of the present invention showing a strap and pocket.

470 First loop
500 Access aperture
502 Access aperture edge
510 Zipper
520 Rap
530 Pouch
540 Stuffing material
550 Granular stuffing material
600 Cavity
610 Second loop
620 Third attachment component
630 Strap
632 Strap first end
634 Strap second end
640 First hook and loop system
650 Pocket
660 Pocket lip
670 Hand held device
680 Second hook and loop system
700 Cushion component
800 First height
810 Second height Referring now to FIG. 1-15, the present invention features a hi-elevation pillow system (100) for allowing two users to lie side by side with each of their heads respectively positioned at a different elevation via the pillow system (100). In some embodiments, the system (100) comprises a base pillow member (200) comprising a general shape of a rectangular prism having a base pillow top surface (210), a generally planar base pillow bottom surface (220) generally parallel to the base pillow top surface (210), a base pillow first side (230), a base pillow second side (240), a base pillow third side (250), and a base pillow fourth side (260). In some embodiments, the base pillow first side (230) is parallel to and opposes the base pillow second side (240). In some embodiments, the base pillow third side (250) is parallel to and opposes the base pillow fourth side (260). In some embodiments, the base pillow first side (230), the base pillow second side (240), the base pillow third side (250) and the base pillow fourth side (260), the base pillow top surface (210) and the base pillow bottom surface (220) are perpendicularly attached on a plurality of base pillow edges (270).

In some embodiments, the base pillow bottom surface (220) comprises a linear channel (280) located thereon. In some embodiments, the linear channel (280) comprises a channel first end (282) and a channel second end (284). In some embodiments, the channel first end (282) is located on the base pillow first side (230) at an intersection with the base pillow bottom surface (220) and the channel second end (284) is located on the base pillow second side (240) at an intersection with the base pillow bottom surface (220). In some embodiments, the channel first end (282) is fluidly connected to the channel second end (284). In some embodiments, the linear channel (280) generally comprises the shape of a half-cylinder when a cylinder is longitudinally intersected by a coronal plane.

In some embodiments, the base pillow member (200) further comprises a cavity (600) having a cushion component (700) located therein.

In some embodiments, the system (100) comprises a secondary pillow member (300) comprising a general shape of a rectangular prism having a secondary pillow top surface (310), a generally planar secondary pillow bottom surface (320) generally parallel to the secondary pillow top surface (310), a secondary pillow first side (330), a secondary pillow second side (340), a secondary pillow third side (350), and a secondary pillow fourth side (360).

In some embodiments, the secondary pillow first side (330) is parallel to and opposes the secondary pillow second side (340). In some embodiments, the secondary pillow third side (350) is parallel to and opposes the secondary pillow fourth side (360). In some embodiments, the secondary pillow first side (330), the secondary pillow second side (340), the secondary pillow third side (350), the secondary pillow fourth side (360), the secondary pillow top surface (310), and the secondary pillow bottom surface (320) are perpendicularly attached on a plurality of secondary pillow edges (370).

In some embodiments, the secondary pillow member (300) further comprises a cavity (600) having a cushion component (700) located therein.

In some embodiments, the system (100) comprises a hinge (400) having a base hinge side (410) located on the base pillow fourth side (260) at an intersection with the base pillow bottom surface (220) and a secondary hinge side (420) located on the secondary pillow fourth side (360) at an intersection with the secondary pillow bottom surface (320).

In some embodiments, the system (100) comprises an attachment system (430) having a first attachment component (440) located on the base pillow member (200) and a correspondingly mated second attachment component (450) located on the secondary pillow member (300).

In some embodiments, in a first position for storage, the base pillow bottom surface (220) interfaces with the secondary pillow bottom surface (320) and is secured in the first position via the attachment system (460). In some embodiments, in a second position for use, the secondary pillow is rotated about the hinge (400) 180 degrees. In some embodiments, the base pillow bottom surface (220) and the secondary pillow bottom surface (320) are placed on a ground surface for use.

In some embodiments, the attachment system (430) comprises a button (460) and loop (470). In some embodiments, the button and loop as used in the present invention may be replaced or substituted by a hook and loop system. In some embodiments, the attachment system (430) comprises a hook and loop system.

In some embodiments, the base pillow member (200) comprises an access aperture (500) located thereon and the secondary pillow member (300) comprises an access aperture (500) located thereon. In some embodiments, the access aperture (500) comprises a zipper (510) located on a pair of access aperture edges (502). In some embodiments, the access aperture (500) comprises a hook and loop system located a pair of access aperture edges (502). In some embodiments, the access aperture (500) comprises a flap (520) located on an access aperture edge (502).

In some embodiments, the cushion component (700) is removable. In some embodiments, the cushion component (700) is fully enveloped and contained by a pouch (530). In some embodiments, the cushion component (700) is stuffing material (540). In some embodiments, the cushion component (700) is granular stuffing material (550).

In some embodiments, the base top surface comprises a curved surface for cervical support. In some embodiments, the base pillow member (200) comprises a first height (800) from the base pillow bottom surface (220) to the base pillow top surface (210) greater than a second height (810) of the secondary pillow member (300) from the secondary pillow bottom surface (320) to the secondary pillow top surface (310).

In some embodiments, an intersecting corner of three base pillow edges (270) or three secondary pillow edges (370) is rounded.

In some embodiments, the system (100) comprises a base pillow member (200) having a base pillow top surface (210) comprising a general shape of a heart, a generally planar base pillow bottom surface (220) comprising a generally matching shape of a heart generally parallel to the base pillow top surface (210). In some embodiments, the system (100) comprises a base pillow side wall perpendicularly attached to the base pillow top surface (210) and the base pillow bottom surface (220) on a plurality of base pillow edges (270). In some embodiments, base pillow member (200) is fully enclosed by the base pillow top surface (210), the base pillow bottom surface (220) and the base pillow side wall.

In some embodiments, the system (100) comprises a base pillow member (200) having a base pillow top surface (210) comprising a general shape of a circle, a generally planar base pillow bottom surface (220) comprising a generally matching shape of a circle generally parallel to the base pillow top surface (210).

In some embodiments, the system (100) comprises a base pillow member (200) having a base pillow top surface (210) comprising a general shape of a star, a generally planar base pillow bottom surface (220) comprising a generally matching shape of a star generally parallel to the base pillow top surface (210).

In some embodiments, the system (100) comprises a base pillow member (200) having a base pillow top surface (210) comprising a general shape of a oval, a generally planar base pillow bottom surface (220) comprising a generally matching shape of a oval generally parallel to the base pillow top surface (210).

In some embodiments, the system (100) comprises a base pillow member (200) having a base pillow top surface (210) comprising a general shape of a rectangle, a generally planar base pillow bottom surface (220) comprising a generally matching shape of a rectangle generally parallel to the base pillow top surface (210).

In some embodiments, the system (100) comprises a base pillow member (200) comprising a general shape of a half-sphere. In some embodiments, the base pillow member (200) comprises a base pillow side wall contiguous with the base pillow top surface (210). In some embodiments, the base pillow bottom surface (220) comprises a generally planar round shape. In some embodiments, the base pillow side wall comprises a circumferential edge disposed on the base pillow bottom surface (220). In some embodiments, the base pillow top surface (210), the base pillow side wall, and the base pillow bottom surface (220) form a shape of a half-sphere. In some embodiments, the base pillow member (200) is fully enclosed by the base pillow top surface (210), the base pillow bottom surface (220) and the base pillow side wall.

In some embodiments, the system (100) comprises a base pillow member (200) having a base pillow top surface (210) comprising a geometric shape, a generally planar base pillow bottom surface (220) comprising a generally matching geometric shape generally parallel to the base pillow top surface (210).

In some embodiments, the system (100) comprises a base pillow member (200) having a base pillow top surface (210) comprising a polygonal shape, a generally planar base pillow bottom surface (220) comprising a generally matching polygonal shape generally parallel to the base pillow top surface (210).

In some embodiments, the system (100) comprises a base pillow member (200) having a base pillow top surface (210) comprising a elliptical shape, a generally planar base pillow bottom surface (220) comprising a generally matching elliptical shape generally parallel to the base pillow top surface (210).

In some embodiments, the base pillow bottom surface (220) comprises a linear channel (280) located thereon. In some embodiments, the linear channel (280) comprises a channel first end (282) and a channel second end (284). In some embodiments, the channel first end (282) is located on the base pillow side wall at an intersection with the base pillow bottom surface (220), and the channel second end (284) is located on an opposing side of the base pillow side wall at an intersection with the base pillow bottom surface (220). In some embodiments, the channel first end (282) is fluidly connected to the channel second end (284). In some embodiments, the linear channel (280) generally comprises the shape of a half-cylinder when a cylinder is longitudinally intersected by a coronal plane.

In some embodiments, the system (100) comprises a hinge (400) having a base hinge side (410) located on the base pillow side wall at an intersection with the base pillow bottom surface (220) and a secondary hinge side (420) located on the secondary pillow side wall at an intersection with the secondary pillow bottom surface (320).

In some embodiments, the system (100) comprises a secondary pillow member (300) having a secondary pillow top surface (310) comprising a general shape of a heart, a generally planar secondary pillow bottom surface (320) comprising a generally matching shape of a heart generally parallel to the secondary pillow top surface (310). In some embodiments, the system (100) comprises a secondary pillow side wall perpendicularly attached to the secondary pillow top surface (310) and the secondary pillow bottom surface (320) on a plurality of secondary pillow edges (370). In some embodiments, secondary pillow member (300) is fully enclosed by the secondary pillow top surface (310), the secondary pillow bottom surface (320) and the secondary pillow side wall.

In some embodiments, the system (100) comprises a secondary pillow member (300) having a secondary pillow top surface (310) comprising a general shape of a circle, a generally planar secondary pillow bottom surface (320) comprising a generally matching shape of a circle generally parallel to the secondary pillow top surface (310).

In some embodiments, the system (100) comprises a secondary pillow member (200) having a secondary pillow top surface (310) comprising a general shape of a star, a generally planar secondary pillow bottom surface (320) comprising a generally matching shape of a star generally parallel to the secondary pillow top surface (310).

In some embodiments, the system (100) comprises a secondary pillow member (200) having a secondary pillow top surface (310) comprising a general shape of a oval, a generally planar secondary pillow bottom surface (320) comprising a generally matching shape of a oval generally parallel to the secondary pillow top surface (310).

In some embodiments, the system (100) comprises a secondary pillow member (200) having a secondary pillow top surface (310) comprising a general shape of a rectangle, a generally planar secondary pillow bottom surface (320) comprising a generally matching shape of a rectangle generally parallel to the secondary pillow top surface (310).

In some embodiments, the system (100) comprises a secondary pillow member (300) comprising a general shape of a half-sphere. In some embodiments, the secondary pillow member (300) comprises a secondary pillow side wall contiguous with the secondary pillow top surface (310). In some embodiments, the secondary pillow bottom surface (320)

comprises a generally planar round shape. In some embodiments, the secondary pillow side wall comprises a circumferential edge disposed on the secondary pillow bottom surface (320). In some embodiments, the secondary pillow top surface (310), the secondary pillow side wall, and the secondary pillow bottom surface (320) form a shape of a half-sphere. In some embodiments, the secondary pillow member (300) is fully enclosed by the secondary pillow top surface (310), the secondary pillow bottom surface (320) and the secondary pillow side wall.

In some embodiments, the system (100) comprises a secondary pillow member (300) having a secondary pillow top surface (310) comprising a geometric shape, a generally planar secondary pillow bottom surface (320) comprising a generally matching geometric shape generally parallel to the secondary pillow top surface (310).

In some embodiments, the system (100) comprises a secondary pillow member (300) having a secondary pillow top surface (310) comprising a polygonal shape, a generally planar secondary pillow bottom surface (320) comprising a generally matching polygonal shape generally parallel to the secondary pillow top surface (310).

In some embodiments, the system (100) comprises a secondary pillow member (300) having a secondary pillow top surface (310) comprising a elliptical shape, a generally planar secondary pillow bottom surface (320) comprising a generally matching elliptical shape generally parallel to the secondary pillow top surface (310).

In some embodiments, a second loop (610) is disposed on the base pillow second side (240), wherein a third attachment component (620) is connected through the second loop (610); wherein a strap (630) is attached to the third attachment component (620).

In some embodiments, the pocket (650) and the second loop (610) and strap (630) system may be on any side or on the underside of the pillow case when it is opened and laying flat.

In some embodiments, the third attachment component (620) has a bendable hooking mechanism so that it can be opened or closed to attach to the second loop (610). In some embodiments, the third attachment component (620) can be a ring, a keychain, a hook, a carabineer, or a combination thereof.

In some embodiments, the strap (630) has a strap first end (632) that is attached to the third attachment component (620), wherein the strap (630) has a strap second end (634) comprising a first hook and loop system (640). In some embodiments, the strap (630) comprises a fabric, an elastic material, a cord, or a combination thereof.

In some embodiments, the first hook and loop system (640) fastens onto a second hook and loop system (680) located on the back of a hand held device (670) to prevent the hand held device (670) from being lost, for example, between couch cushions or under a blanket. In some embodiments, the hand held device (670) is a television remote, a stereo remote, a cell phone, a house phone, or the like.

In some embodiments, a pocket (650) is disposed on the secondary pillow second side (340) for additional storage space; wherein the pocket (650) has a pocket lip (660) to reinforce an opening of the pocket. In some embodiments, the pocket (650) comprises a fabric, an elastic material, a mesh material, a polymer material, or a combination thereof.

In some embodiments, the pocket lip (660) comprises a fabric, an elastic material, a polymer material, or a combination thereof.

In some embodiments, the pocket (650) is located on the same pillow and on the same surface as the second loop (610).

In some embodiments, the second loop (610), the third attachment component (620) and the strap (630) may be located inside the pocket (650) in order to hide them from sight. The strap (630) will come out from the pocket (650) when it is attached to a hand held device (670).

As used herein, the term "about" refers to plus or minus 10% of the referenced number. For example, an embodiment wherein the hinge is about 10 inches in length includes a hinge that is between 9 and 11 inches in length.

The disclosures of the following U.S. patents are incorporated in their entirety by reference herein: U.S. Pat. No. 5,029,350. U.S. Pat. No. 5,765,245; U.S. Pat. No. 7,305,728; U.S. Pat. Pub. No. 2008/0028530; U.S. Pat. No. D 387,599; U.S. Pat. No. D 446,676.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bi-elevation pillow system (100) for allowing two users to lie side by side with each of their heads respectively positioned at a different elevation via the pillow system (100), wherein said system (100) comprises:

(a) a base pillow member (200) comprising a general shape of a rectangular prism having a base pillow top surface (210), a generally planar base pillow bottom surface (220) generally parallel to the base pillow top surface (210), a base pillow first side (230), a base pillow second side (240), a base pillow third side (250), and a base pillow fourth side (260), wherein the base pillow first side (230) is parallel to and opposes the base pillow second side (240), wherein the base pillow third side (250) is parallel to and opposes the base pillow fourth side (260), wherein the base pillow first side (230), the base pillow second side (240), the base pillow third side (250) and the base pillow fourth side (260), the base pillow top surface (210) and the base pillow bottom surface (220) are perpendicularly attached on a plurality of base pillow edges (270), wherein the base pillow bottom surface (220) comprises a linear channel (280) disposed thereon, wherein the linear channel (280) comprises a channel first end (282) and a channel second end (284), wherein the channel first end (282) is disposed on the base pillow first side (230) at an intersection with the base pillow bottom surface (220) and the channel second end (284) is disposed on the base pillow second side (240) at an intersection with the base pillow bottom surface (220), wherein the channel first end (282) is fluidly connected to the channel second end (284), wherein the linear channel (280) generally comprises the shape of a half-cylinder when a cylinder is longitudinally intersected by a coronal plane, wherein the base pillow member (200) further comprises a cavity (600) having a cushion component (700) disposed therein;

(b) a secondary pillow member (300) comprising a general shape of a rectangular prism having a secondary pillow top surface (310), a generally planar secondary pillow bottom surface (320) generally parallel to the secondary pillow top surface (310), a secondary pillow first side (330), a secondary pillow second side (340), a secondary pillow third side (350), and a secondary pillow fourth side (360), wherein the secondary pillow first side (330) is parallel to and opposes the secondary pillow second side (340), wherein the secondary pillow third side (350) is parallel to and opposes the secondary pillow fourth side (360), wherein the secondary pillow first side (330), the secondary pillow second side (340), the secondary pillow third side (350) the secondary pillow fourth side (360), the secondary pillow top surface (310) and the secondary pillow bottom surface (320) are perpendicularly attached on a plurality of secondary pillow edges (370), wherein the secondary pillow member (300) further comprises a cavity (600) having a cushion component (700) disposed therein;

(c) a hinge (400) having a base hinge side (410) disposed on the base pillow fourth side (260) at an intersection with the base pillow bottom surface (220) and a secondary hinge side (420) disposed on the secondary pillow fourth side (360) at an intersection with the secondary pillow bottom surface (320); and (d) an attachment system (430) having a first attachment component (440) disposed on the base pillow member (200) and a correspondingly mated second attachment component (450) disposed on the secondary pillow member (300);

wherein in a first position for storage, the base pillow bottom surface (220) interfaces with the secondary pillow bottom surface (320) and is secured in the first position via the attachment system (460), wherein in a second position for use, the secondary pillow is rotated about the hinge (400) 180 degrees, wherein the base pillow bottom surface (220) and the secondary pillow bottom surface (320) are placed on a ground surface for use, (e) a second loop (610) disposed on the base pillow second side (240), wherein a third attachment component (620) is connected through the second loop (610); wherein a strap (630) is attached to the third attachment component (620), (f) a pocket (650) disposed on the secondary pillow second side (340) for additional storage space: wherein the pocket (650) has a pocket lip (660) to reinforce an opening of the pocket.

2. The system (100) of claim 1, wherein the attachment system (430) comprises a button (460) and loop (470).

3. The system (100) of claim 1, wherein the attachment system (430) comprises a hook and loop system.

4. The system (100) of claim 1, wherein the base pillow member (200) comprises an access aperture (500) disposed thereon and the secondary pillow member (300) comprises an access aperture (500) disposed thereon.

5. The system (100) of claim 4, wherein the access aperture (500) comprises a zipper (510) disposed on a pair of access aperture edges (502).

6. The system (100) of claim 4, wherein the access aperture (500) comprises a hook and loop system disposed a pair of access aperture edges (502).

7. The system (100) of claim 4, wherein the access aperture (500) comprises a flap (520) disposed on an access aperture edge (502).

8. The system (100) of claim 1, wherein the cushion component (700) is removable.

9. The system (100) of claim 8, wherein the cushion component (700) is fully enveloped and contained by a pouch (530).

10. The system (100) of claim 1, wherein the cushion component (700) is stuffing material (540).

11. The system (100) of claim 1, wherein the cushion component (700) is granular stuffing material (550).

12. The system (100) of claim 1, wherein the base top surface comprises a curved surface for cervical support.

13. The system (100) of claim 1, wherein the base pillow member (200) comprises a first height (800) from the base pillow bottom surface (220) to the base pillow top surface (210) greater than a second height (810) of the secondary pillow member (300) from the secondary pillow bottom surface (320) to the secondary pillow top surface (310).

14. The system (100) of claim 1, wherein an intersecting corner of three base pillow edges (270) or three secondary pillow edges (370) is rounded.

15. The system (100) of claim 1, wherein the third attachment component (620) can be opened or closed to attach to the second loop (610).

16. The system (100) of claim 1, wherein the third attachment component (620) is a ring, a keychain, a hook, a carabineer, or a combination thereof.

17. The system (100) of claim 1, wherein the strap (630) has a strap first end (632) that is attached to the third attachment component (620), wherein the strap (630) has a strap second end (634) comprising a first hook and loop system (640), wherein the first hook and loop system fastens onto a second hook and loop system (680) located on the back of a hand held device (670) to prevent the hand held device from being lost.

18. The system (100) of claim 1, wherein the strap (630) comprises a fabric, an elastic material, a cord, or a combination thereof.

19. The system (100) of claim 1, wherein the pocket (650) comprises a fabric, an elastic material, a mesh material, a polymer material, or a combination thereof.

20. The system (100) of claim 1, wherein the pocket lip (660) comprises a fabric, an elastic material, a polymer material, or a combination thereof.

* * * * *